US008714920B2

(12) United States Patent
Campbell et al.

(10) Patent No.: US 8,714,920 B2
(45) Date of Patent: May 6, 2014

(54) TURBINE AIRFOIL TO SHROUND ATTACHMENT

(75) Inventors: Christian X. Campbell, Oviedo, FL (US); Jay A. Morrison, Oviedo, FL (US); Allister W. James, Chuluota, FL (US); Raymond G. Snider, Orlando, FL (US); Daniel M. Eshak, Orlando, FL (US); John J. Marra, Winter Springs, FL (US); Brian J. Wessell, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 1070 days.

(21) Appl. No.: 12/752,460

(22) Filed: Apr. 1, 2010

(65) Prior Publication Data

US 2011/0243724 A1 Oct. 6, 2011

(51) Int. Cl.
*F01D 1/02* (2006.01)
*F04D 29/54* (2006.01)

(52) U.S. Cl.
USPC ..... 415/191; 415/200; 415/208.2; 415/209.3; 416/204 R

(58) Field of Classification Search
CPC ..... F01D 5/00; F01D 5/12; F01D 5/141; F01D 5/143; F01D 9/00; F01D 9/042; F01D 5/3038; F01D 5/30; F01D 25/28; F01D 25/30; F01D 25/246; F01D 9/023; F01D 9/044; F01D 9/06; F01D 25/005; F01D 25/12; F01D 9/04; F04D 29/24; F04D 29/245; F04D 29/263
USPC ..... 415/134, 137, 138, 139, 191, 185, 189, 415/200, 208.1, 208.2, 209.2, 209.3, 210.1; 416/179, 180, 204 R, 214 R, 214 A, 416/219 R, 220 R, 221
See application file for complete search history.

(56) References Cited

U.S. PATENT DOCUMENTS

| | | | |
|---|---|---|---|
| 3,669,177 | A | 6/1972 | Ingalls et al. |
| 3,732,031 | A | 5/1973 | Bowling et al. |
| 3,878,880 | A | 4/1975 | Jones |
| 4,008,052 | A | 2/1977 | Vishnevsky et al. |
| 4,195,683 | A | 4/1980 | Blazek |
| 4,489,469 | A | 12/1984 | Hall |
| 4,494,287 | A | 1/1985 | Cruzen et al. |
| 4,538,331 | A | 9/1985 | Egan et al. |
| 4,592,120 | A | 6/1986 | Egan et al. |
| 4,728,258 | A | 3/1988 | Blazek et al. |

(Continued)

*Primary Examiner* — Edward Look
*Assistant Examiner* — Christopher J Hargitt

(57) ABSTRACT

A turbine airfoil (31) with an end portion (42) that tapers (44) toward the end (43) of the airfoil. A ridge (46) extends around the end portion. It has proximal (66) and distal (67) sides. A shroud platform (50) is bi-cast onto the end portion around the ridge without bonding. Cooling shrinks the platform into compression (62) on the end portion (42) of the airfoil. Gaps between the airfoil and platform are formed using a fugitive material (56) in the bi-casting stage. These gaps are designed in combination with the taper angle (44) to accommodate differential thermal expansion while maintaining a gas seal along the contact surfaces. The taper angle (44) may vary from lesser on the pressure side (36) to greater on the suction side (38) of the airfoil. A collar portion (52) of the platform provides sufficient contact area for connection stability.

11 Claims, 4 Drawing Sheets

(56) References Cited

U.S. PATENT DOCUMENTS

| | | | | |
|---|---|---|---|---|
| 4,869,645 | A | 9/1989 | Verpoort | |
| 4,955,423 | A | 9/1990 | Blazek | |
| 4,961,459 | A | 10/1990 | Blazek | |
| 4,987,944 | A | 1/1991 | Parks | |
| 5,069,265 | A | 12/1991 | Blazek | |
| 5,181,550 | A | 1/1993 | Blazek et al. | |
| 5,241,737 | A | 9/1993 | Colvin | |
| 5,241,738 | A | 9/1993 | Colvin | |
| 5,263,530 | A | 11/1993 | Colvin | |
| 5,290,143 | A * | 3/1994 | Kington et al. | 415/191 |
| 5,332,022 | A | 7/1994 | Colvin | |
| 5,332,360 | A | 7/1994 | Correia et al. | |
| 5,377,742 | A | 1/1995 | Jarry | |
| 5,678,298 | A | 10/1997 | Colvin et al. | |
| 5,797,725 | A | 8/1998 | Rhodes | |
| 5,981,083 | A | 11/1999 | Colvin et al. | |
| 6,409,473 | B1 * | 6/2002 | Chen et al. | 415/191 |
| 6,648,597 | B1 * | 11/2003 | Widrig et al. | 415/200 |
| 7,045,220 | B2 | 5/2006 | Ishiduka et al. | |
| 7,284,590 | B2 | 10/2007 | Liimatainen | |
| 2006/0239825 | A1 * | 10/2006 | Rice et al. | 416/241 R |

* cited by examiner

TURBINE AIRFOIL TO SHROUND ATTACHMENT

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

This invention relates to mechanisms and methods for attachment of turbine airfoils to shroud platforms, and particularly to bi-casting of shroud platforms onto turbine airfoils.

BACKGROUND OF THE INVENTION

Bi-casting is a two-step process whereby one section of a component is cast, and then a second section is cast onto the first section in a second casting operation. Bi-casting has been utilized in gas turbine engine fabrication of vane rings and blades. Complex shapes can be designed for bi-casting that would exceed limits of castability in a single casting, and each section can have specialized material properties. Costly materials and processes such as single crystals can be selectively used where needed, reducing total cost.

A vane ring is a circular array of radially oriented stationary vane airfoils mounted between radially inner and outer shroud rings. The vane airfoils may be cast first, and then placed in a mold in which the inner and outer shroud rings are bi-cast onto the inner and outer ends of the airfoils respectively. The vane rings may be fabricated in segments. One or multiple vanes may be cast into an inner and/or an outer shroud segment to form a vane ring segment. A shroud segment on an end of a vane is called a platform.

A metallurgical bond may not form between the vane airfoils and the platforms. An oxide layer develops on the surface of the airfoil that prevents the molten metal of the platform from bonding to it. This may be overcome in order to form a bond. However, interlocking geometry without bonding has been used in the vane/platform interface to form a mechanical interconnection only.

In large gas turbines, differential thermal expansion (DTE) creates stresses between the vanes airfoils and shrouds. Providing clearance to accommodate DTE can result in lack of connection stability, stress concentrations, hot gas ingestion, and leakage of cooling air into the working gas flow from plenums and channels in the shrouds and vanes.

BRIEF DESCRIPTION OF THE DRAWINGS

The invention is explained in the following description in view of the drawings that show.

DETAILED DESCRIPTION OF THE INVENTION

The present invention provides a mechanical interlock between a vane and a bi-cast platform that accommodates differential thermal expansion while maximizing connection stability and minimizing stress concentrations and coolant leakage.

Figure 1:
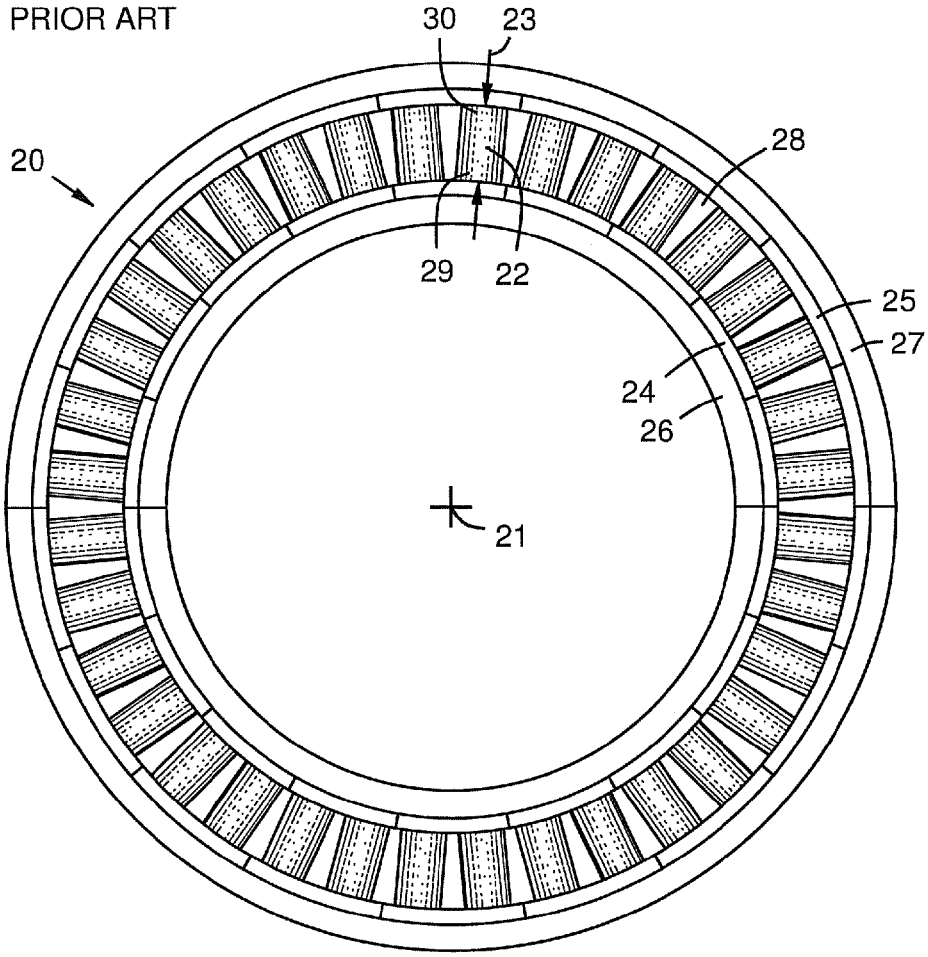
FIG 1 PRIOR ART
FIG. 1 schematically illustrates a prior art ring of vanes centered on an axis.

FIG. 1 illustrates a prior art ring 20 of stationary vanes 22 centered on an axis 21 in a turbine. Each vane 22 is an airfoil with first and second ends 29, 30. The vane spans radially 23 between inner and outer shroud segments or platforms 24, 25. Herein "radially" means perpendicular to the axis 21. The platforms 24, 25 may be attached to respective inner and outer ring structures 26, 27, which may be support rings and/or cooling air plenum structures. Between each pair of vanes 22 is a working gas flow passage 28. In a gas turbine, the vanes 22 direct a combustion gas flow against an adjacent downstream ring of rotating blades not shown. Individual vane segments are traditionally cast with one or more airfoils per pair of inner/outer platforms 24, 25 to form what is sometimes called a nozzle. For large industrial gas turbine vanes, easily cast alloys (e.g. the cobalt based alloy ECY-768) may be cast with two or three airfoils per vane segment, while alloys that are more difficult to cast (e.g. nickel based superalloys such as IN939 and CM247LC) are limited to single airfoil vane segments.

Figure 2:
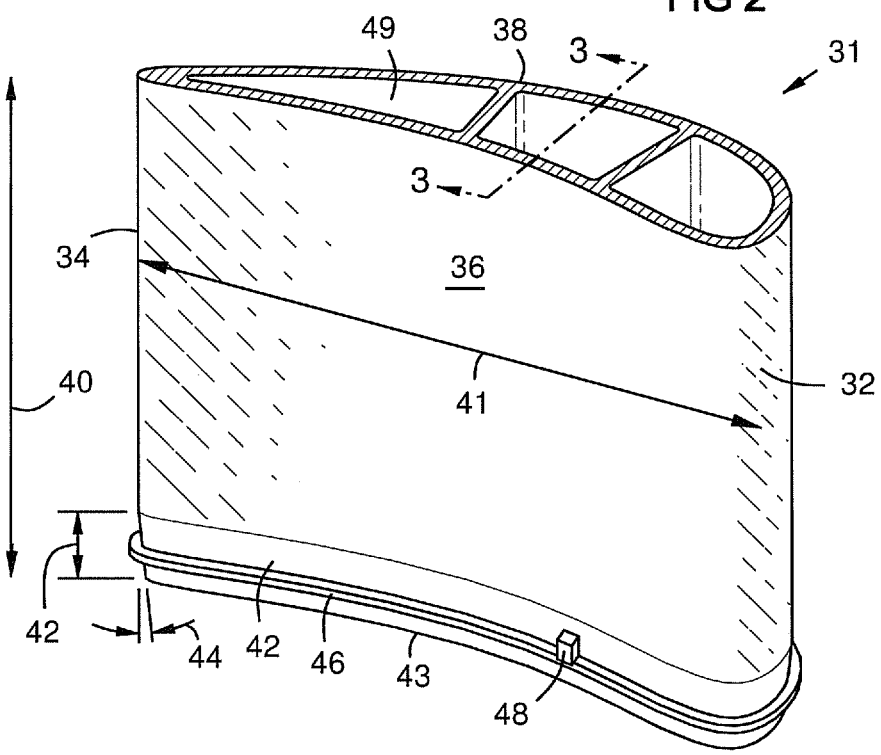
FIG. 2 is a partial perspective view of a vane airfoil according to aspects of the invention.
Figure 3:
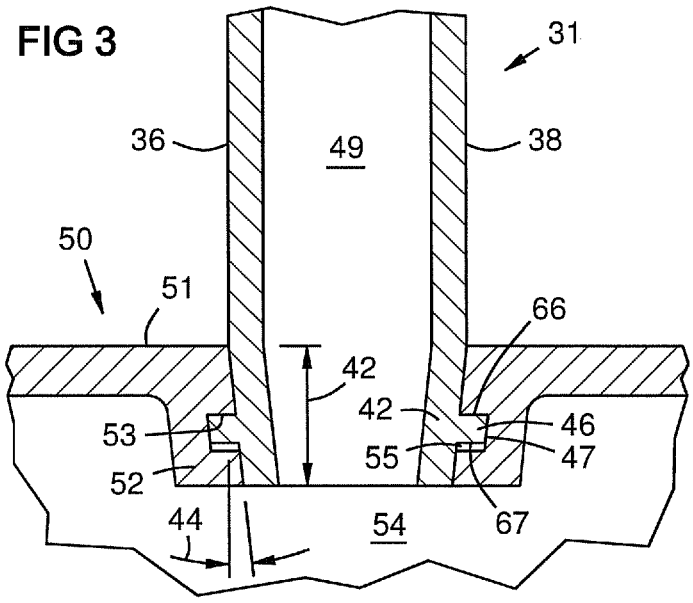
FIG. 3 is a sectional view taken along line 3-3 of FIG. 2 including a partial shroud platform.

FIGS. 2 and 3 show a portion of a turbine airfoil 31 according to an embodiment of the invention. It has leading and trailing edges 32, 34, pressure and suction sides 36, 38, an end 43, and an end portion 42 with a taper 44 and a ridge 46 with proximal and distal sides 66, 67. The ridge 46 may surround the airfoil continuously or discontinuously along the pressure side, leading edge, suction side, and trailing edge. A radial spanwise dimension 40 is defined along a length of the airfoil. A chordwise dimension 41 is defined between the leading and trailing edges 32, 34, and may be considered as being parallel to a working gas containment surface 51 at the connection under consideration.

Figure 6:
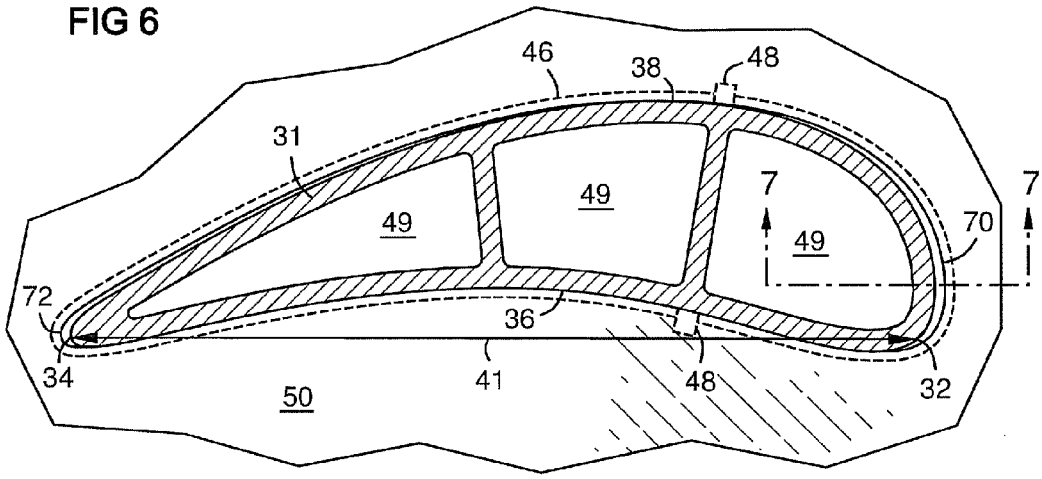
FIG. 6 shows a partial plan view of a platform with a vane in section.

A tab 48 may extend from the pressure and/or suction sides of the end portion 42 to function in cooperation with an associated vane platform to define an origin for differential expansion and contraction of the platform in the chordwise dimension. Tab 48 may be located for example at a mid-chord position or at a maximum airfoil thickness position as shown in FIG. 6. The opposite end of the airfoil 31 (not shown) may use the same connection type as the shown end portion 42 or it may use a different connection type. Cooling chambers 49 may be provided in the airfoil.

FIG. 3 is a sectional view taken along line 3-3 of FIG. 2. A bi-cast platform 50 has a working gas containment surface 51 and a collar portion 52 that holds the end portion 42 of the airfoil 31. It may have a cooling air plenum 54. The ridge 46 has a proximal side 66 that contacts a proximal side 53 of a bi-cast groove surrounding the ridge 46 in the collar 52. Clearance 55 is provided in the groove below the ridge 46 for spanwise differential expansion of the airfoil. The ridge 46 may have a top surface 47 aligned with the adjacent taper angle 44.

The taper angle 44 may vary around the airfoil to accommodate varying amounts of differential contraction of the platform 50 and collar 52 at different points around the curvature of the airfoil. The taper angle on the pressure side 36 may be less than on the suction side in order to equalize pressure on the various contact surfaces. In an exemplary engineering model, a taper angle of 3-5 degrees on the pressure side and 50% greater than the pressure side taper angle on the suction side was found to be advantageous—for example, 4 degrees on the pressure side and 6 degrees on the suction side. The optimum angles depend on the airfoil shape.

Figure 4:
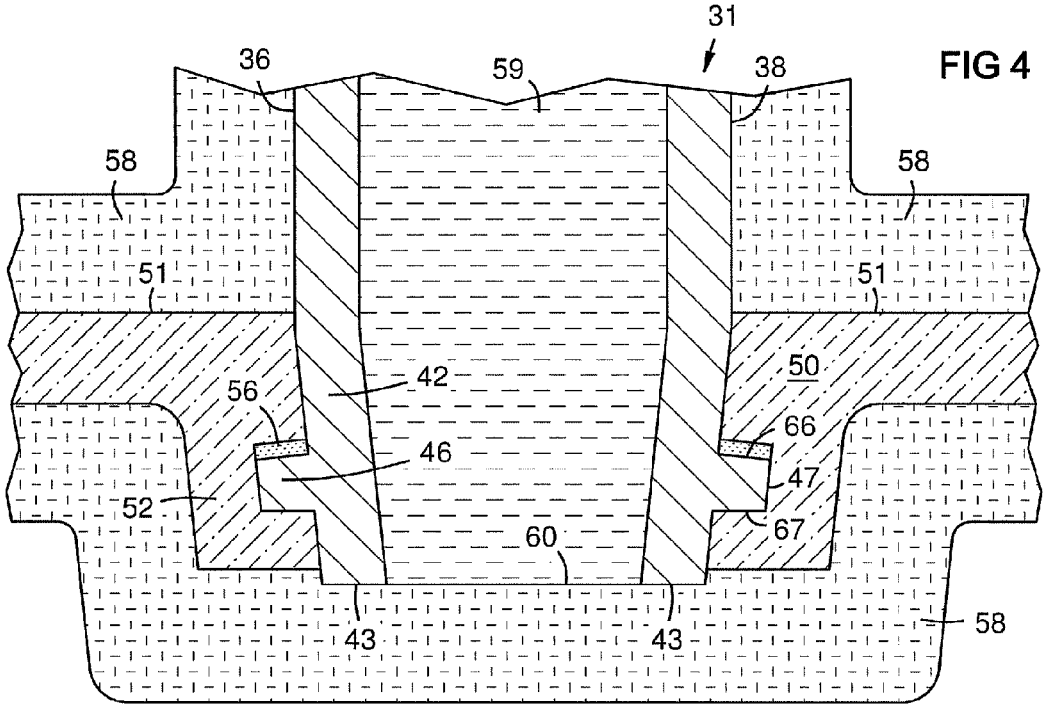
FIG. 4 is a sectional view of a stage of bi-casting of a platform on an end portion of a vane in which the platform is molten.

FIG. 4 illustrates a stage of bi-casting in a mold 58 in which the platform 50 material is molten. The mold material may encapsulate the airfoil. The airfoil 31 may be filled with a fugitive ceramic core 59 to block the molten alloy from entering the cooling chambers. The tapered end 42 of the airfoil is placed in the mold 58. The mold may have a positioning depression 60 that fits the end 43 of the airfoil to a given depth 63 best seen in FIG. 5. For example, this depth may be equal to the clearance 55. Prior to placing the airfoil in the mold, a layer of fugitive material 56 may be applied to the proximal side 66 of the ridges 46 as shown.

Figure 5:
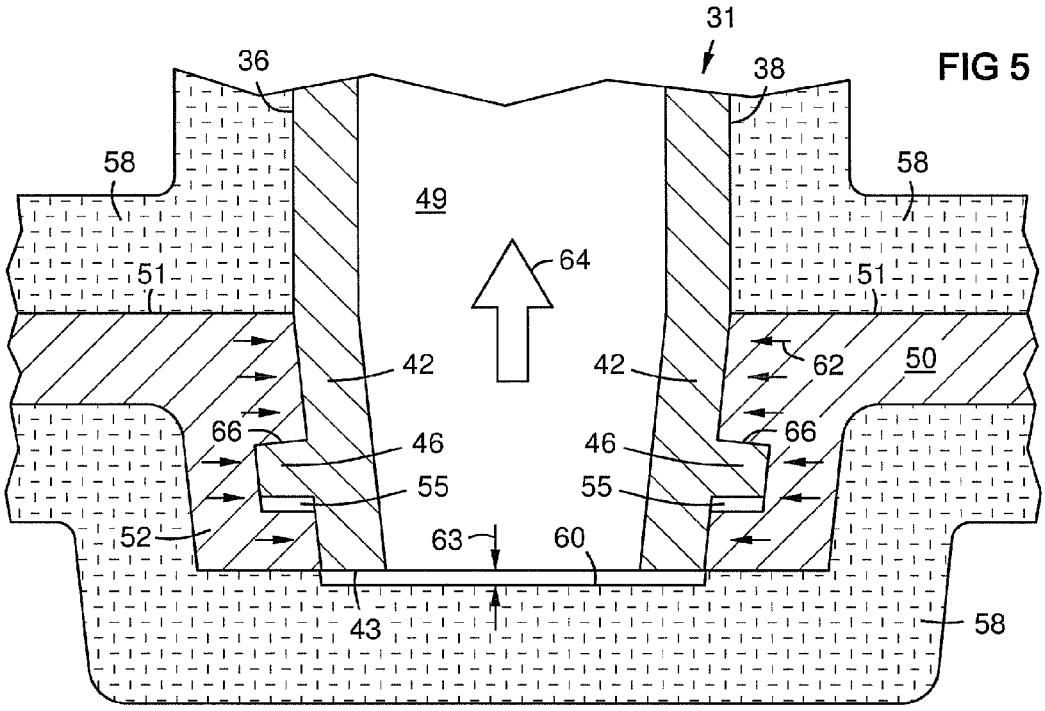
FIG. 5 is a sectional view of a stage of bi-casting in which the platform has solidified and contracted and fugitive materials have been removed.

FIG. 5 illustrates a stage of bi-casting after the platform 50 has solidified and further cooled. The platform 50 shrinks 62 as it cools. The airfoil 31 shrinks less than the platform due to a temperature differential during bi-casting. Molten metal is poured or injected into the mold 58. The airfoil stays cooler than the platform during bi-casting. As an example, the temperature of the airfoil end portion 42 may reach about 900° C. when the platform solidifies at about 1300° C. Cooling from this point causes differential shrinkage that compresses 62 the collar 52 onto the tapered end portion 42 of the airfoil. This pushes 64 the airfoil upward in the drawing, or proximally with respect to the airfoil, due to the reverse wedging effect of the taper 44. The taper angle should be high enough to overcome the high contact friction between the contacting surfaces to allow sliding.

Figure 7:
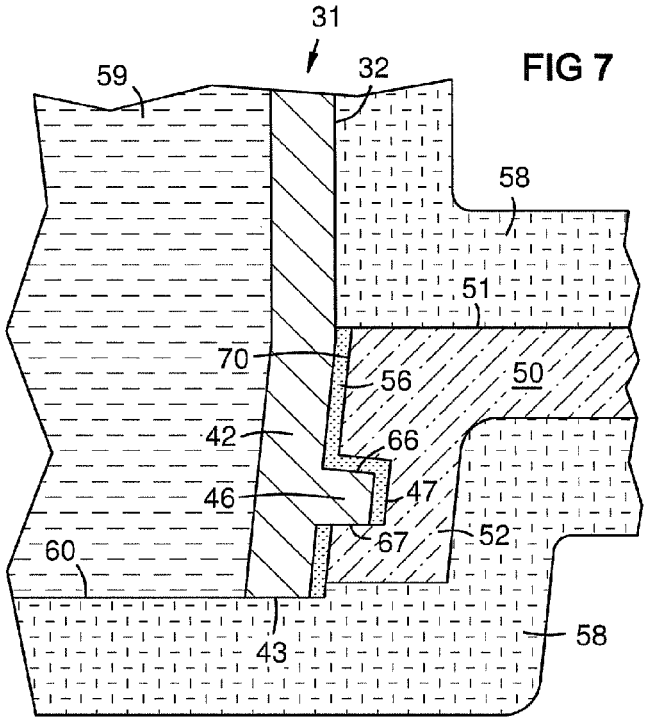
FIG. 7 shows a sectional view taken along line 7-7 of FIG. 6

FIG. 6 shows a partial plan view of a platform 50 with a vane 31 in section. Stress relief slots 70, 72 may be provided at the leading edge 32 and/or trailing edge 34 to accommodate platform contraction during casting, and airfoil expansion during operation. These slots 70, 72 may be formed with a fugitive material such as alumina and/or silica coating deposited by slurry or a spray process that is chemically leached away after casting. This may be a continuation of the fugitive material 56 on the ridge 46. The leaching chemical may reach the fugitive material on the ridge 46 via the stress relief slots 70, 72. The slots 70, 72 may extend across the tapered end portion as seen in FIG. 7. They may extend in respective leading and trailing chordwise directions 41.

FIG. 7 shows a sectional view taken along line 7-7 of FIG. 6, illustrating a stage of bi-casting with fugitive material 56 on the leading edge of the tapered end portion 42 to form a leading edge stress relief slot 70.

The combination of stress relief slots 70, 72, spanwise clearance gap 55, and varying taper angles 44 provides substantially uniformly distributed contact pressures in the connection over a range of operating temperatures and differential thermal expansion conditions. The connection allows a limited range of relative movement, maintains a gas seal along the contact surfaces, minimizes vibration, minimizes stress concentrations, and provides sufficient contact area and pressure for rigidity and stability of the vane ring assembly.

The use of bi-casting enables less costly repair should the platform become damaged in service. The platform can be cut off, saving the high-value airfoil, and then a new replacement platform can be bi-cast onto the airfoil.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine airfoil to shroud attachment, comprising:

a turbine airfoil comprising a tapered end portion that tapers toward an end of the airfoil;

a ridge on the tapered end portion, the ridge comprising a proximal side and a distal side relative to the airfoil;

a bi-cast platform on the end portion without a bond therebetween; and a gap between the platform and the distal side of the ridge;

wherein the proximal side of the ridge contacts the platform; and wherein the tapered end portion of the airfoil has a taper angle that varies around the airfoil.

2. The turbine airfoil to shroud attachment of claim 1, wherein the ridge further comprises a top surface aligned with the tapered end portion.

3. The turbine airfoil to shroud attachment of claim 1, wherein the platform comprises a collar surrounding the tapered end portion of the airfoil, and the collar exerts compression on the tapered end portion of the airfoil, creating a reverse wedging effect that pushes the airfoil proximally and pushes the proximal side of the ridge into contact with a proximal side of a surrounding bi-cast groove in the platform.

4. The turbine airfoil to shroud attachment of claim 1, wherein the platform comprises leading and trailing edge stress relief slots that provide clearance between the platform and respective leading and trailing edges of the tapered end portion of the airfoil.

5. The turbine airfoil to shroud attachment of claim 1, wherein the taper angle is smaller on a pressure side of the airfoil than on a suction side of the airfoil.

6. The turbine airfoil to shroud attachment of claim 5, wherein the taper angle is 3-5 degrees on the pressure side and 50% greater than the pressure side taper angle on the suction side of the airfoil.

7. A turbine vane to shroud attachment method, comprising:

forming a turbine vane with an end portion, wherein the end portion has an outer surface comprising:

a pressure side, a suction side, a leading edge, and a trailing edge;

a taper that reduces the vane distally, wherein the taper varies from less taper on the pressure side to more taper on the suction side;

a ridge with a proximal side, a distal side, and a top surface;

wherein the top surface of the ridge aligns with the taper;

disposing a fugitive layer on the proximal side of the ridge and on at least one of the leading edge and the trailing edge of the end portion of the vane;

bi-casting a platform onto the end portion of the turbine vane without a metallurgical bond therebetween, wherein the platform compresses the end portion of the vane upon solidifying;

removing the fugitive layer; and controlling the varying taper and thicknesses of the fugitive layer to minimize stress concentrations in contact pressures between the turbine vane and the platform over a range of operating temperatures and differential thermal expansion conditions.

8. The turbine vane to shroud attachment method of claim 7, further comprising forming a tab extending from at least one of the pressure side and the suction side of the end portion of the vane at a mid-chord position or at a maximum airfoil thickness position of the vane to define an origin for expansion and contraction of the platform relative to the vane in a chordwise dimension.

9. The turbine vane of claim 8, comprising controlling the varying angle of the taper and the thicknesses of the fugitive layer on the ridge and on the leading and trailing edges to provide substantially uniform contact between the turbine vane and the platform over the range of operating temperatures and differential thermal expansion conditions.

10. A turbine airfoil to shroud attachment, comprising:

a turbine airfoil comprising a tapered end portion that tapers toward an end of the airfoil;

a ridge on the tapered end portion, the ridge comprising a proximal side and a distal side relative to the airfoil;

a bi-cast platform on the end portion without a bond therebetween; and a gap between the platform and the distal side of the ridge;

wherein the proximal side of the ridge contacts the platform; and further comprising a tab extending from an outer surface of the tapered end portion of the airfoil into a cooperating recess in the platform to establish an origin for differential expansion of the airfoil relative to the platform in a chordwise dimension.

11. A turbine vane to shroud attachment, comprising:

a turbine vane with a spanwise dimension;

a tapered end portion of the turbine vane with an outer surface comprising:

a taper that reduces the vane distally;

a ridge with a proximal side and a distal side;

a bi-cast platform surrounding and compressing the end portion of the turbine vane without bonding thereto;

the proximal side of the ridge pressing against a proximal side of a bi-cast groove in the platform surrounding the ridge;

a gap between the distal side of the ridge and a distal side of the groove surrounding the ridge in the platform;

a gap between the platform and a trailing edge of the tapered end portion of the vane for differential expansion of the platform in a chordwise dimension;

a gap between the platform and a leading edge of the tapered end portion of the vane for differential expansion of the platform in the chordwise dimension; and a tab extending from the outer surface of the tapered end portion of the vane into the platform from a maximum airfoil thickness position, wherein the tab establishes an origin for differential expansion of the platform and the vane in the chordwise dimension.

* * * * *